US007071671B2

(12) United States Patent
Kitagawa et al.

(10) Patent No.: US 7,071,671 B2
(45) Date of Patent: Jul. 4, 2006

(54) CIRCUIT FOR SUPPLYING CONSTANT VOLTAGE

(75) Inventors: Masahiro Kitagawa, Nukata-gun (JP); Akio Kojima, Anjo (JP); Junichi Nagata, Nukata-gun (JP)

(73) Assignee: Denso Corporation, Kariya (JP)

( * ) Notice: Subject to any disclaimer, the term of this patent is extended or adjusted under 35 U.S.C. 154(b) by 47 days.

(21) Appl. No.: 10/974,769

(22) Filed: Oct. 28, 2004

(65) Prior Publication Data

US 2005/0140350 A1 Jun. 30, 2005

(30) Foreign Application Priority Data

Dec. 25, 2003 (JP) ..... 2003-429825

(51) Int. Cl.
*G05F 3/16* (2006.01)

(52) U.S. Cl. ..... 323/313; 323/315

(58) Field of Classification Search ..... 323/312, 323/313, 314, 315; 327/538, 539
See application file for complete search history.

(56) References Cited

U.S. PATENT DOCUMENTS 4,338,646 A * 7/1982 Davis et al. ..... 323/315
5,168,210 A * 12/1992 Thus ..... 323/313
6,255,807 B1 * 7/2001 Doorenbos et al. ..... 323/314

FOREIGN PATENT DOCUMENTS

JP A-7-261862 10/1995
JP A-2003-150256 5/2003

* cited by examiner

*Primary Examiner*—Jessica Han
(74) *Attorney, Agent, or Firm*—Posz Law Group, PLC

(57) ABSTRACT

A constant voltage supplying circuit including an output transistor is connected to a power source line and an output terminal. A base-emitter voltage of the output transistor is detected by a voltage detecting circuit composed of a transistor. A current-outputting circuit for supplying a current determined based on the voltage detected by the voltage detector to a reference voltage supplying circuit is used in the constant voltage supplying circuit. The reference voltage is supplied to a base of the output transistor to cancel a base-emitter voltage of the output transistor and to equalize the output voltage to a voltage generated in a reference voltage generating element included in the reference voltage supplying circuit. In this manner, the output voltage is kept constant notwithstanding variation of output current.

11 Claims, 4 Drawing Sheets

CIRCUIT FOR SUPPLYING CONSTANT VOLTAGE

CROSS-REFERENCE TO RELATED APPLICATION

This application is based upon and claims benefit of priority of Japanese Patent Application No. 2003-429825 filed on Dec. 25, 2003, the content of which is incorporated herein by reference.

BACKGROUND OF THE INVENTION

1. Field of the Invention

The present invention relates to an electric circuit for supplying a constant voltage to loads connected thereto.

2. Description of Related Art

Examples of an electric circuit for supplying a constant voltage are disclosed in JP-A-2003-150256 and in JP-A-7-261862. Generally in the conventional circuits, a Zener diode for generating a reference voltage is used. An essence of the conventional circuits is shown in FIG. 6 attached hereto. Between a power source line 1 connected to a power source (such as a battery having voltage VB) and a ground 2, a series circuit composed of a constant current circuit 3 and a reference voltage supplying circuit 4 is connected. The reference voltage supplying circuit 4 is a series circuit consisting of a diode D1 and a Zener diode D2 connected in series. The reference voltage supplying circuit 4 supplies a reference voltage Vr to a base of a transistor Q1. A collector of the transistor Q1 is connected to a power source line 1, and an emitter thereof is connected to an output terminal 5.

The diode D1 connected to the Zener diode D2 in series functions to cancel a base-emitter voltage Vbe of the transistor Q1 with a forward voltage Vf of the diode D1. It is intended, in this manner, to decrease temperature dependency of the output voltage Vout and to control the output voltage Vout to a voltage substantially equal to a Zener voltage Vz. However, the base-emitter voltage Veb of the transistor Q1 becomes unequal to the forward voltage Vf of the diode V1 when an amount of output current changes, because the base-emitter voltage Vbe of the transistor Q1 changes depending on an amount of output current. This means that the base-emitter voltage Vbe of the transistor Q1 cannot be always canceled with the forward voltage Vf of the diode D1, and therefore the output voltage Vout cannot be maintained at a constant level with high accuracy.

SUMMARY OF THE INVENTION

The present invention has been made in view of the above-mentioned problem, and an object of the present invention is to provide an improved constant voltage supplying circuit that is able to supply a constant voltage with high accuracy.

In the constant voltage circuit, an output transistor is connected between a power source line connected to a power source such as a battery and an output terminal to which electrical loads are connected. A base-emitter voltage Vbe of the output transistor is detected by a voltage detecting circuit composed of a transistor. A circuit composed of a current-outputting circuit and a reference voltage supplying circuit, both connected in series, is connected between the power source line and the ground. The reference voltage supplying circuit is composed of a diode and a Zener diode, both connected in series. The diode may be a diode-connected transistor, and the Zener diode functions as a reference voltage generating element. The Zener diode may be replaced with a band-gap reference voltage generating element.

An amount of current outputted from the current-outputting circuit is controlled to be proportional to the base-emitter voltage Vbe of the output transistor which is detected by the voltage detecting circuit. A reference voltage Vr generated in the reference voltage supplying circuit according to the amount of current from the current-outputting circuit is supplied to the base of the output transistor. A forward voltage of the diode becomes equal to the base-emitter voltage Vbe of the output transistor, and accordingly the output voltage Vout becomes equal to the Zener voltage Vz generated in the Zener diode. In other words, the base-emitter voltage Vbe depending on an amount of output current is canceled by the forward voltage of the diode, and the output voltage Vout is always maintained equal to the Zener voltage Vz. In this manner, the output voltage Vout is kept constant with high accuracy notwithstanding variation in the amount of the output current.

The voltage detector composed of a transistor may be regarded as a current detector because a current proportional to the output current of the output transistor flows in the transistor forming the detector. The current-outputting circuit may be composed of a current-mirror circuit including a pair of transistors. A circuit for supplying a constant current to the Zener diode may be added to the constant voltage supplying circuit to surely establish the Zener voltage Vz even when the current supplied from the current-supplying circuit is low. A starting-up circuit for supplying a base current according to the Zener voltage Vz to the base of the output transistor may be added to thereby quickly start-up the constant voltage supplying circuit. Further, a load through which a predetermined amount of current flows may be connected between the output terminal and the ground to thereby further stabilize the operation of the constant voltage supplying circuit.

Other objects and features of the present invention will become more readily apparent from a better understanding of the preferred embodiments described below with reference to the following drawings.

DETAILED DESCRIPTION OF THE PREFERRED EMBODIMENTS

Figure 1A:
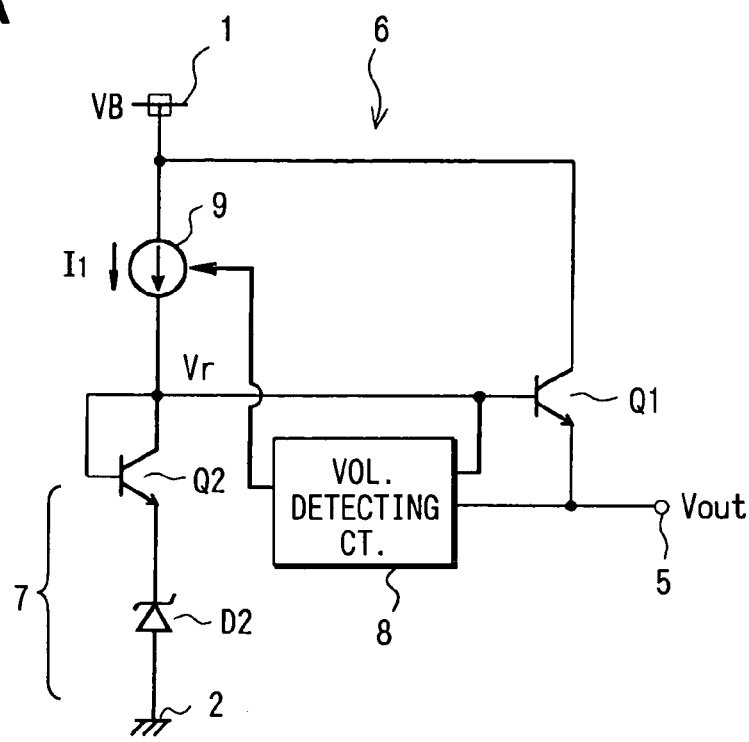
FIG. 1A is a circuit diagram showing a constant voltage supplying circuit as a first embodiment of the present invention.

A first embodiment of the present invention will be described with reference to FIGS. 1A, 1B and 2A, 2B. FIG. 1A shows a constant voltage supplying circuit 6 formed in an integrated circuit. A power source voltage such as a battery voltage VB is supplied between a power source line 1 and a ground 2, and electrical loads are connected to an output terminal 5. A collector of a transistor Q1 (an output transistor) is connected to the power source line 1, while an emitter of the transistor Q1 is connected to the output terminal 5. A reference voltage supplying circuit 7 consisting of a transistor Q2 (diode-connected) and a Zener diode D2, both connected in series, is connected between a base of the transistor Q1 and the ground 2. The Zener diode D2 is referred to as a reference voltage generating element.

A current-outputting circuit 9 is connected between the power source line 1 and the reference voltage supplying circuit 7. A voltage detecting circuit 8 detects a base-emitter voltage Vbe of the transistor Q1, and the detected voltage Vbe is used to control an amount of current $I_1$ of the current-outputting circuit 9.

Figure 1B:
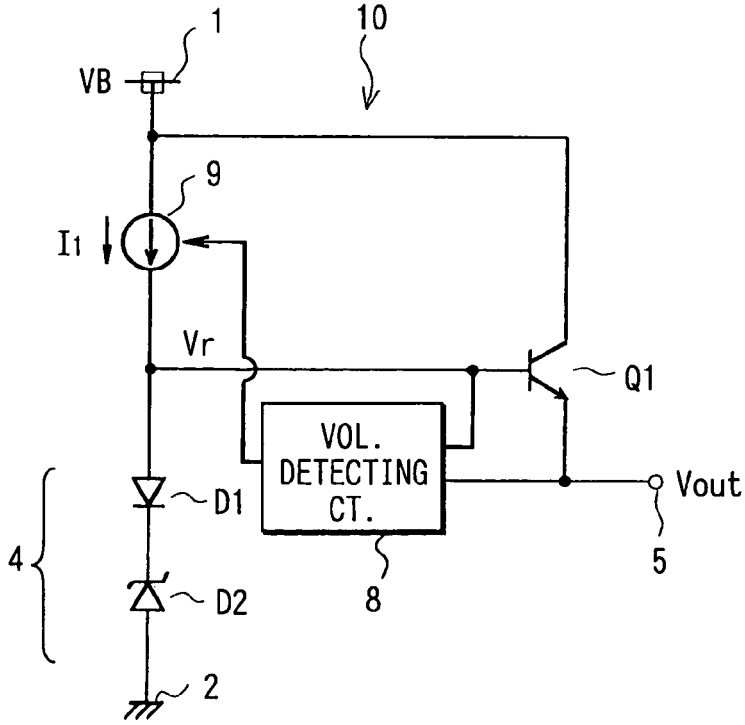
FIG. 1B is a circuit diagram showing a constant voltage supplying circuit as a modified form of the first embodiment shown in FIG. 1A.

A constant voltage supplying circuit 10 shown in FIG. 1B is a modified form of the constant voltage supplying circuit 6 shown in FIG. 1A. The transistor Q2 is replaced with a diode D1, and other structures are the same as those in the circuit shown in FIG. 1A. That is, a reference voltage supplying circuit 4 is composed of the diode D1 and the Zener diode D2, both connected in series, in the constant voltage supplying circuit 10.

Figure 2A:
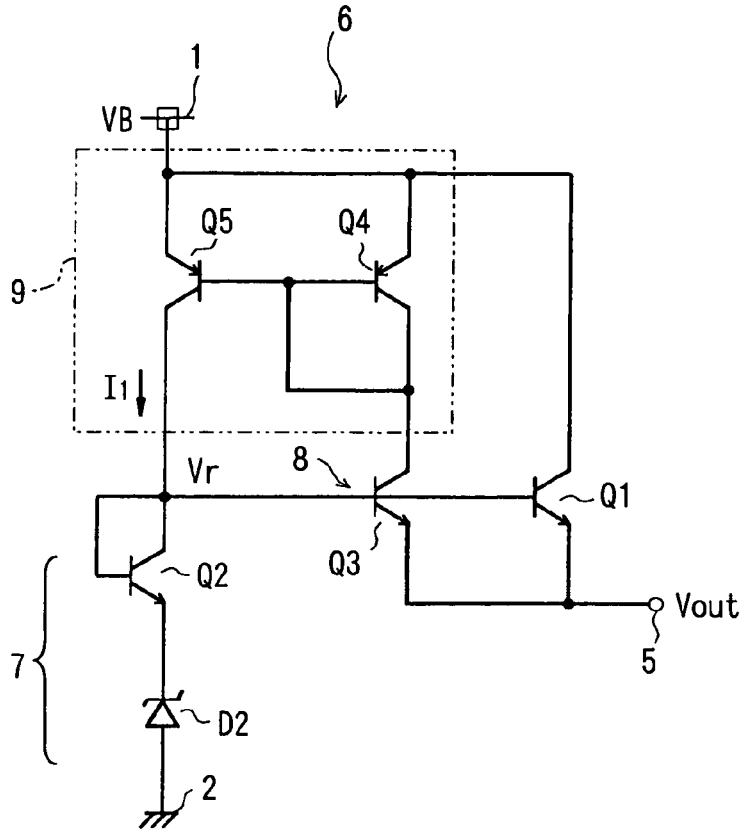
FIG. 2A is a circuit diagram showing the circuit shown in FIG. 1A in detail.
Figure 2B:
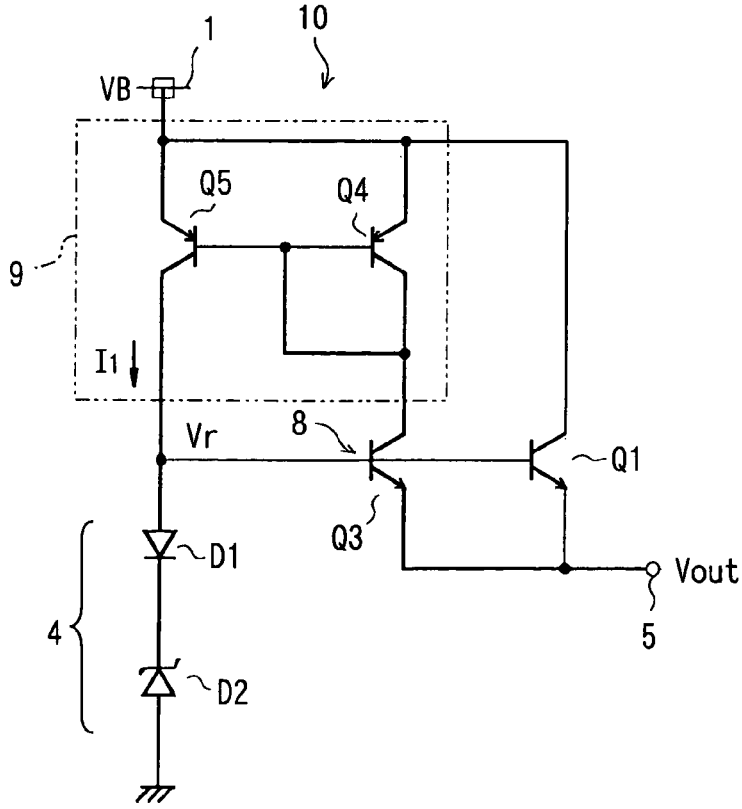
FIG. 2B is a circuit diagram showing the circuit shown in FIG. 1B in detail.

FIG. 2A shows the constant voltage supplying circuit 6 (shown in FIG. 1A), in which the current-outputting circuit 9 and the voltage detecting circuit 8 are shown in detail. Similarly, FIG. 2B shows the constant voltage supplying circuit 10 (shown in FIG. 1B), in which the circuits 9 and 8 are shown in detail. A transistor Q3 functions as the voltage detecting circuit 8. A base of the transistor Q3 is connected to the base of the transistor Q1, and an emitter of the transistor Q3 is connected to the emitter of the transistor Q1. A transistor Q4 connected between the power source line 1 and the collector of the transistor Q3, and a transistor Q5 connected between the power source line 1 and the bases of the transistors Q1–Q3 constitute a current-mirror circuit. The current-mirror circuit functions as the current-outputting circuit 9.

Operation of the constant voltage supplying circuit 6 shown in FIG. 2A will be explained. The current-outputting circuit 9 supplies a bias current to the reference voltage supplying circuit 7 and a base current to the transistor Q1. Upon supplying the bias current to the reference voltage supplying circuit 7, a base emitter voltage Vbe(Q2) of the transistor Q2 is generated between the collector and the emitter of the transistor Q2. At the same time, a Zener voltage Vz is generated across the Zener diode D2. That is, the reference voltage Vr (Vr=Vbe(Q2)+Vz) is generated and supplied to the base of the transistor Q1. The transistor Q1 operates under the base voltage Vr and supplies current to loads connected to the output terminal 5. The output voltage Vout is expressed as: Vout=Vr−Vbe(Q1)=Vbe(Q2)−Vbe(Q1)+Vz, where Vbe(Q1) is a base-emitter voltage of the transistor Q1.

It is seen in the above equation that the output voltage Vout becomes equal to the Zener voltage Vz when Vbe(Q2) and Vbe(Q1) are controlled to become equal. However, that cannot be attained unless a certain control is preformed because the base-emitter voltage of the transistors varies according to a collector current. In the constant voltage supplying circuit shown in FIG. 2A, the voltage detecting circuit 8 and the current-outputting circuit 9 are provided. The base-emitter voltage Vbe(Q2) of the transistor Q2 is controlled according to the base-emitter voltage Vbe(Q1) to attain the relation Vbe(Q2)=Vbe(Q1).

More particularly, a collector current corresponding to the emitter-base voltage Vbe(Q1) of the transistor Q1 flows through the transistor Q3. The collector current of the transistor Q3 is reflected by the current-mirror circuit consisting of the transistors Q4 and Q5 and becomes an output current $I_1$ of the current-outputting circuit 9. For example, when the base-emitter voltage Vbe(Q1) of the transistor Q1 becomes high according to increase in the output current supplied to the loads, the current $I_1$ from the current-outputting circuit 9 increases, and the current flowing through the reference voltage supplying circuit 7 increases. According to the increase in the current $I_1$, the base-emitter voltage Vbe(Q2) of the transistor Q2 becomes high.

On the other hand, when the base-emitter voltage Vbe (Q1) of the transistor Q1 becomes low according to decrease in the output current supplied to the loads, the current $I_1$ from the current-outputting circuit 9 decreases, and the current flowing through the reference voltage supplying circuit 7 decreases. According to the decrease in the current $I_1$, the base-emitter voltage Vbe(Q2) of the transistor Q2 becomes low. As a results, the base-emitter voltages Vbe (Q1) and Vbe(Q2) of both transistors Q1 and Q2 become always equal, not depending on the amount of the output current supplied to the loads, and accordingly the output voltage Vout is maintained at a level of the Zener voltage Vz with high accuracy.

The accuracy of the output voltage Vout is further enhanced by using the transistors Q1, Q2 and Q3 having the same characteristics. In addition, by positioning the transistors Q1, Q2 and Q3 closer to one another, the base-emitter voltages of all the transistors vary in the same direction and by the same amount according to temperature changes. As a result, Vbe(Q1) and Vbe(Q2) are kept at a level equal to each other not withstanding temperature changes. Thus, the output voltage Vout is maintained at a constant level with high accuracy.

The constant voltage supplying circuit 10 shown in FIG. 2B operates in the same manner as described above. Accordingly, the explanation will not be repeated here.

An amount of current flowing through the transistor Q3 is proportional to an amount of current flowing through the transistor Q1. The proportionality factor is determined by a ratio of emitter area of both transistors Q1 and Q3. The transistor Q3 may also be regarded as a current detecting circuit. A base-emitter voltage Vbe of a transistor increases according to an increase in a collector current. From this viewpoint, the current detecting circuit constituted by the transistor Q3 can be observed as functioning in the following manner. A bias current, an amount of which corresponds to the current of transistor Q1 which is detected by the transistor Q3, is supplied to the reference voltage supplying circuit 7 (or 4 in the circuit shown in FIG. 2B). By supplying such bias current, the base-emitter voltage Vbe(Q2) is equalized to the base-emitter voltage Vbe(Q1), and the output voltage Vout coincides with the Zener voltage Vz with high accuracy.

Figure 3:
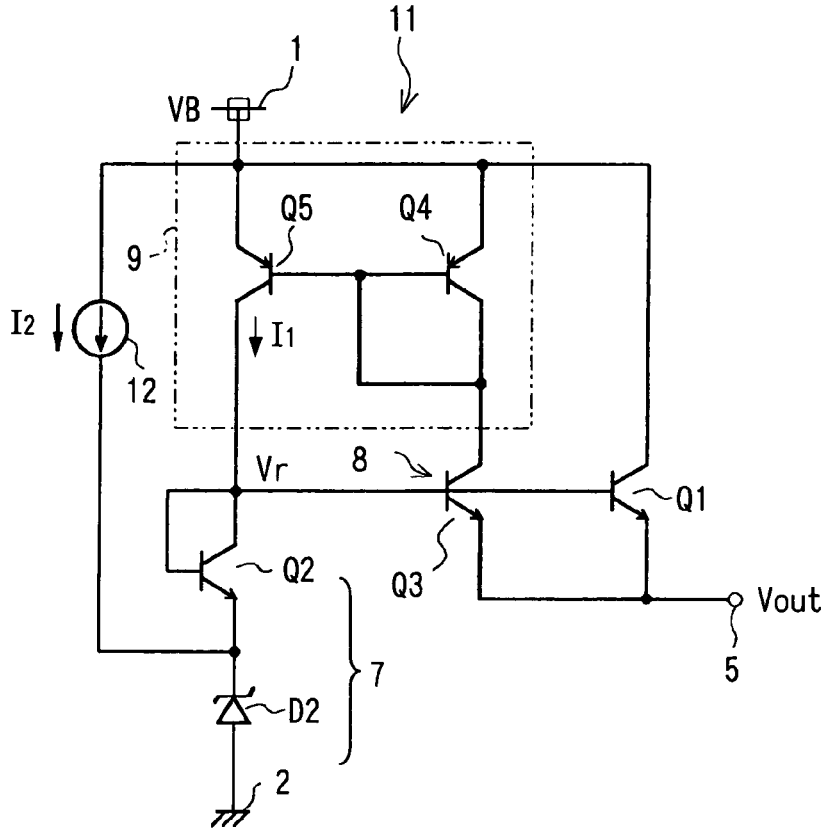
FIG. 3 is a circuit diagram showing a constant voltage supplying circuit as a second embodiment of the present invention.

A constant voltage supplying circuit 11 as a second embodiment of the present invention is shown in FIG. 3. In this embodiment, a constant current supplying circuit 12 is additionally connected between the power source line 1 and a cathode of the Zener diode D2. Other structures are the same as those of the first embodiment. An amount of current $I_2$ of the constant current supplying circuit 12 is set to an amount that is sufficiently high to establish a stable Zener voltage Vz in the Zener diode D2.

In this second embodiment, even if the current $I_1$ from the current outputting circuit 9 decreases to a level that is too low to establish the Zener voltage Vz (due to decrease in the output current supplied from the output terminal 5), at least the current $I_2$ is supplied to the Zener diode D2 from the constant current supplying circuit 12. Accordingly, the Zener voltage Vz is established without fail and the stable output voltage Vout is obtained.

Figure 4:
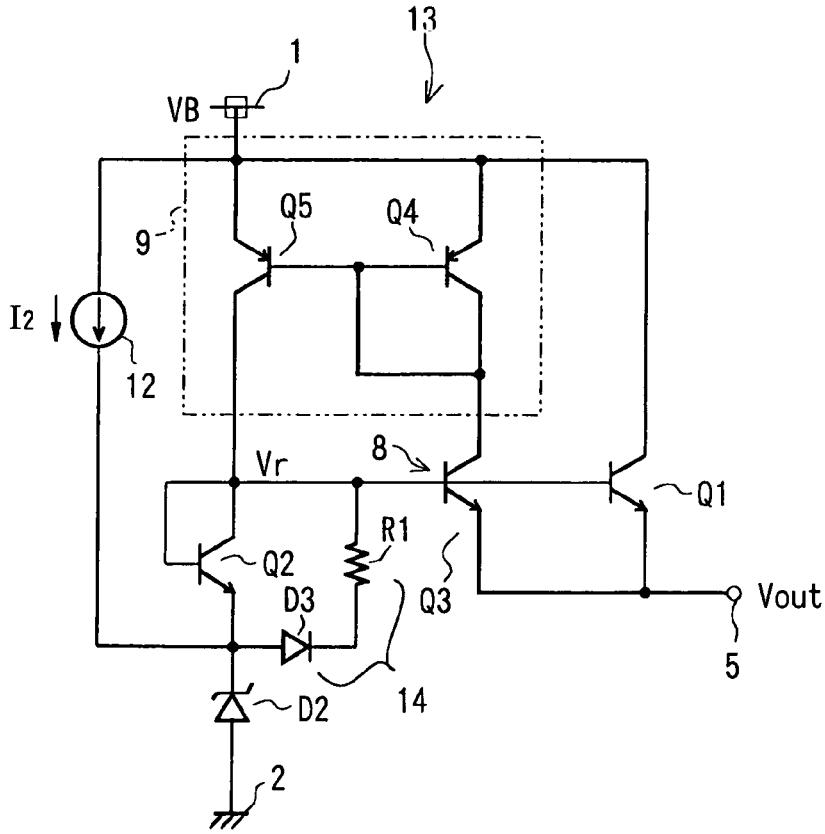
FIG. 4 is a circuit diagram showing a constant voltage supplying circuit as a third embodiment of the present invention.

A constant voltage supplying circuit 13 as a third embodiment of the present invention is shown in FIG. 4. In this embodiment, a starting-up circuit 14 consisting of a diode D3 and a resistor R1, both connected in series, is additionally connected between the cathode of the Zener diode D2 and the base of the transistor Q3. Other structures are the same as those of the second embodiment described above. In this third embodiment, when the power source voltage VB is supplied between the power source line 1 and the ground 2, the current $I_2$ is supplied to the Zener diode D2 to thereby establish the Zener voltage Vz. At the same time, a base current is supplied to the transistors Q1 and Q3 through the starting-up circuit 14. Therefore, the output voltage Vout is quickly established without fail.

Figure 5:
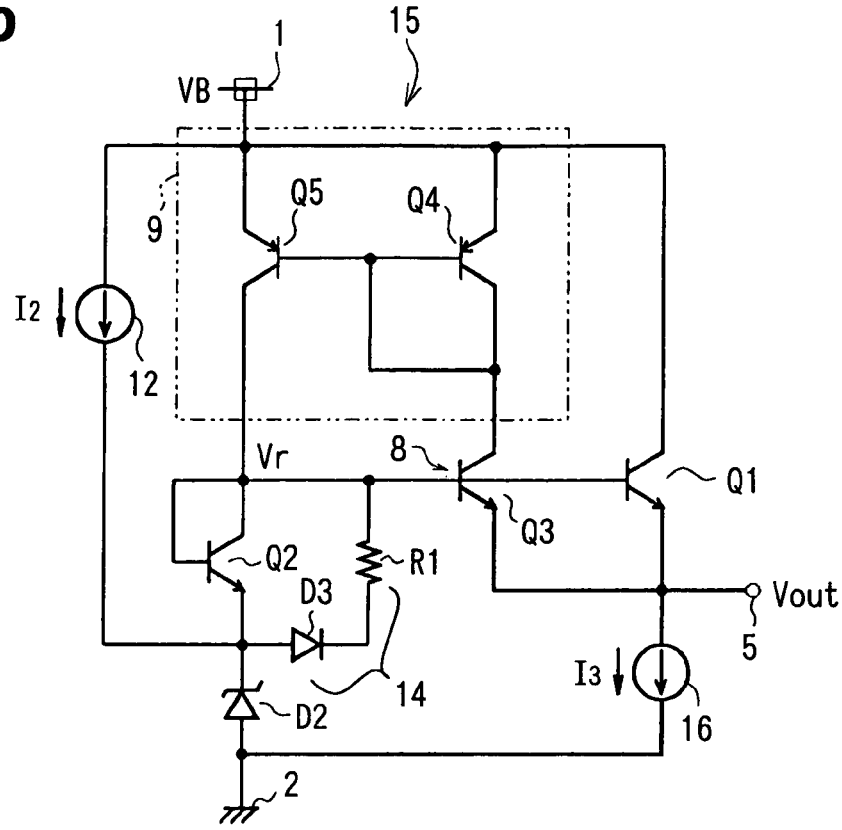
FIG. 5 is a circuit diagram showing a constant voltage supplying circuit as a fourth embodiment of the present invention.
Figure 6:
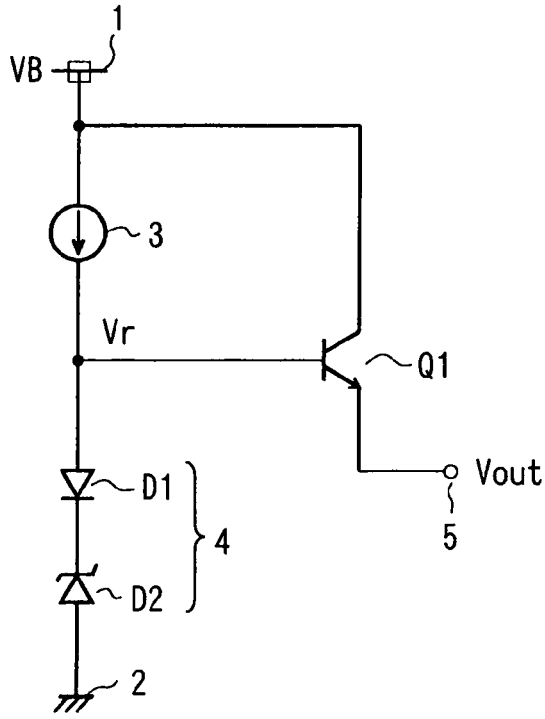
FIG. 6 PRIOR ART
FIG. 6 is a circuit diagram showing an essence of a conventional constant voltage supplying circuit.

A constant voltage supplying circuit 15 as a fourth embodiment of the present invention is shown in FIG. 5. In this embodiment, a load 16 through which a predetermined amount of current $I_3$ flows is additionally connected between the output terminal 5 and the ground 2. Other structures are the same as those of the third embodiment described above. In this fourth embodiment, at least a constant current $I_3$ flows through the transistor Q1 not withstanding decrease in an amount of the output current. Accordingly, respective current corresponding to the current flowing through the transistor Q1 flows through the transistors Q2, Q3 and the current-outputting circuit 9. Therefore, the constant voltage supplying circuit 15 stably operates as a whole, and the operation becomes highly stable against noises. The amount of current $I_3$ is determined to obtain desired stability and desired strength against noises. The load 16 through which a predetermined amount of current flows may be added to the first and the second embodiments as well.

The present invention is not limited to the embodiments described above, but it may be variously modified. For example, the transistor Q2 used in the second, third and fourth embodiments may be replaced with the diode D1 used in the modified form of the first embodiment. The Zener diode D2 is used as a reference voltage generating element in all the embodiments described above. However, the Zener diode D2 may be replaced with other elements such as a band-gap reference voltage generating element. An NPN transistor is used as the transistor Q1, it may be replaced with a PNP transistor. In this case, the constant voltage supplying circuit is constituted as a circuit in which current is sunk from the output terminal 5. In the fourth embodiment, a resistor maybe used in place of the constant current supplying circuit 16.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A circuit for supplying a constant voltage to electrical loads connected to an output terminal thereof, the circuit comprising:

an output transistor, an emitter of which is connected to the output terminal;

a reference voltage supplying circuit for supplying a reference voltage to a base of the output transistor, the reference voltage supplying circuit being composed of a reference voltage generating element and a diode, both connected in series;

a voltage detecting circuit for detecting a voltage between the base and the emitter of the output transistor; and a current-outputting circuit for supplying a current to the reference voltage supplying circuit, the current being determined based on the voltage detected by the voltage detecting circuit.

2. The circuit as in claim 1, wherein:

the voltage detecting circuit is composed of a voltage detecting transistor, an emitter of which is connected to the emitter of the output transistor, and a base of which is connected to the base of the output transistor; and the current-outputting circuit is composed of a current-mirror circuit to which the current flowing through the voltage detecting transistor is supplied.

3. A circuit for supplying a constant voltage to electrical loads connected to an output terminal thereof, the circuit comprising:

an output transistor, an emitter of which is connected to the output terminal;

a reference voltage supplying circuit for supplying a reference voltage to a base of the output transistor, the reference voltage supplying circuit being composed of a reference voltage generating element and a diode, both connected in series;

a current detecting circuit for detecting a collector current of the output transistor; and a current-outputting circuit for supplying a current to the reference voltage supplying circuit, the current being determined based on the current detected by the current detecting circuit.

4. The circuit as in claim 3, wherein:

the current detecting circuit is composed of a current detecting transistor, an emitter of which is connected to the emitter of the output transistor, and a base of which is connected to the base of the output transistor; and the current-outputting circuit is composed of a current-mirror circuit to which the current flowing through the current detecting transistor is supplied.

5. The circuit as in any one of claims 1–4, further comprising a constant current supplying circuit for supplying a constant current only to the reference voltage generating element.

6. The circuit as in claim 5, further comprising a starting-up circuit for supplying a base current to the output transistor according to the reference voltage generated by the reference voltage generating element.

7. The circuit as in claim 6, further comprising a load through which a predetermined amount of current flows, the load being connected between the output terminal and the ground.

8. The circuit as in any one of claims 1–4, further comprising a load through which a predetermined amount of current flows, the load being connected between the output terminal and the ground.

9. The circuit as in any one of claims 1–4, the diode in the reference voltage supplying circuit is a diode-connected transistor having the same characteristics as the output transistor.

10. The circuit as in any one of claims 1–4, the reference voltage generating element is a Zener diode.

11. The circuit as in any one of claims 1–4, the reference voltage generating element is a band-gap reference voltage generating element.

* * * * *